US007637321B2

(12) United States Patent
Zazovsky et al.

(10) Patent No.: US 7,637,321 B2
(45) Date of Patent: Dec. 29, 2009

(54) APPARATUS AND METHOD FOR UNSTICKING A DOWNHOLE TOOL

(75) Inventors: Alexander F. Zazovsky, Houston, TX (US); Richard Meehan, Beijing (CN); Bunker M. Hill, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 188 days.

(21) Appl. No.: 11/763,018

(22) Filed: Jun. 14, 2007

(65) Prior Publication Data

US 2008/0308279 A1 Dec. 18, 2008

(51) Int. Cl.
*E21B 31/00* (2006.01)

(52) U.S. Cl. ..... 166/301; 166/241.5

(58) Field of Classification Search ..... 166/104, 166/223, 241.3, 241.5, 264, 301, 382; 175/325.3
See application file for complete search history.

(56) References Cited

U.S. PATENT DOCUMENTS 1,272,253 A * 7/1918 Green ..... 166/104
1,427,944 A * 9/1922 Crotto ..... 166/223
3,724,540 A * 4/1973 Urbanosky et al. ..... 166/100
3,934,468 A 1/1976 Brieger
4,192,380 A * 3/1980 Smith ..... 166/254.2
4,474,235 A * 10/1984 Coshow ..... 166/241.5
4,860,581 A 8/1989 Zimmerman et al.
4,893,505 A 1/1990 Marsden et al.
4,936,139 A 6/1990 Zimmerman et al.
5,622,223 A 4/1997 Vasquez
5,631,413 A * 5/1997 Young et al. ..... 73/152.29
5,652,617 A * 7/1997 Barbour ..... 348/85
5,836,406 A * 11/1998 Schuh ..... 175/61
7,082,994 B2 * 8/2006 Frost et al. ..... 166/254.2
7,216,726 B2 * 5/2007 Swietlik et al. ..... 175/73

* cited by examiner

*Primary Examiner*—Jennifer H Gay
*Assistant Examiner*—Blake Michener
(74) *Attorney, Agent, or Firm*—Dave R. Hofman; Darla Fonseca; Jaime Castano

(57) ABSTRACT

A downhole tool is provided including apparatus for unsticking the tool from the wall or a borehole. The tool may include a housing defining a longitudinal axis and a sleeve coupled to the housing and mounted for rotation relative to the housing, the sleeve having an exterior surface including at least one projection extending radially outwardly with respect to the longitudinal axis. A transmission mechanism may be coupled to and adapted to rotate the sleeve, and a motor may be coupled to the transmission mechanism. A method for unsticking the downhole tool by rotating a sleeve is also disclosed.

15 Claims, 4 Drawing Sheets

APPARATUS AND METHOD FOR UNSTICKING A DOWNHOLE TOOL

BACKGROUND

1. Technical Field

This disclosure generally relates to oil and gas well drilling and the subsequent investigation of subterranean formations surrounding the well. More particularly, this disclosure relates to apparatus and methods for disengaging or "unsticking" a tool from the wall of the well.

2. Description of the Related Art

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation fluid mobility. These measurements are essential to predicting the production capacity and production lifetime of a subsurface formation.

One technique for measuring formation and fluid properties includes lowering a "wireline" tool into the well to measure formation properties. A wireline tool is a measurement tool that is suspended from a wireline in electrical communication with a measurement tool that is suspended from a wireline in electrical communication with a control system disposed on the surface. The tool is lowered into a well so that it can measure formation properties at desired depths. A typical wireline tool may include a probe that may be pressed against the wellbore wall to establish fluid communication with the formation. This type of wireline tool is often called a "formation tester." Using the probe, a formation tester measures the pressure of the formation fluids and generates a pressure pulse, which is used to determine the formation permeability. The formation tester tool may also withdraw a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip" uphole. Further, the wireline tools must be lowered to the zone of interest, generally at or near the bottom of the hole. The combination of removing the drill string and lowering the wireline tool downhole is time-consuming and can take up to several hours, depending on the depth of the wellbore. Because of the great expense and rig time required to "trip" the drill pipe and lower the wireline tool down the wellbore, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling). A variety of downhole MWD and LWD drilling tools are commercially available.

MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms. Furthermore, LWD and MWD are not necessarily performed while the drill bit is actually cutting through the formation. For example, LWD and MWD may occur during interruptions in the drilling process, such as when the drill bit is briefly stopped to take measurements, after which drilling resumes. Measurements taken during intermittent breaks in drilling are still considered to be made "while-drilling" because they do not require the drill string to be tripped.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

In oil and gas operations, downhole tools (such as wire line tools or drill strings) are conveyed into and withdrawn from the wellbore. Occasionally, during operation, the downhole tool may become stuck in the wellbore. Tool sticking often occurs during formation evaluation procedures, such as coring or formation fluid sampling, where a piston and/or a probe are extended into contact with the mudcake lining the wellbore. Alternatively, a tool may also become stuck during delivery into or removal from the wellbore should it contact with and breach the integrity of the mudcake layer. The formation itself is typically at a relatively lower pressure, while the wellbore is at a relatively higher pressure. Consequently, it is possible for a downhole tool to dislodge a portion of the mudcake layer and expose the tool to a significant pressure differential that holds the tool against the wellbore wall. The holding force generated by the pressure differential is difficult to overcome and often may exceed the force capable of being generated by a backup piston, probe, or other extendible component of the tool. The use of pistons to dislodge a stuck tool is also unsatisfactory because the exact portion of the tool that is in contact with the wall is typically not known, and therefore several pistons spaced circumferentially about the tool must be provided in order to insure that a pushing force can be generated in the appropriate direction. Such pistons can be damaged during tool release operations, preventing their retraction and exacerbating the sticking problem. Other known methods for disengaging downhole tools, such as fishing, cable pulling, and tool pushing by tubing, are overly difficult and time consuming.

SUMMARY OF THE DISCLOSURE

A downhole tool is provided including apparatus for unsticking the tool from the wall of a borehole. The tool may include a housing defining a longitudinal axis and a sleeve coupled to the housing and mounted for rotation relative to the housing, the sleeve having an exterior surface including at least one projection extending radially outwardly with respect to the longitudinal axis. A transmission mechanism may be coupled to and adapted to rotate the sleeve, and a motor may be coupled to the transmission mechanism.

In a refinement, the sleeve exterior surface may have a cross-sectional area that is greater than a cross-sectional area of the housing. In a further refinement, the sleeve exterior surface may have three projections.

In another refinement, the sleeve may be mounted on a mandrel that is scaled from the housing, thereby to provide a self-contained module.

In a further refinement, the transmission mechanism may include a gear having teeth adapted to operatively engage splines formed on an internal surface of the sleeve.

In yet another refinement, the housing may include an additional projection extending radially outwardly with respect to the longitudinal axis.

In still another refinement, the tool may further include a controller operatively coupled to the motor for controlling rotational speed of the motor.

An alternative downhole tool adapted for unsticking form a borehole wall is also disclosed, and may include a cylindrical housing defining a cross-sectional area and defining a longitudinal axis. A sleeve may be coupled to be substantially coaxial with the housing and mounted for rotation relative to the housing, the sleeve having an exterior surface defining a cross-sectional area that is larger than the cross-sectional area of the cylindrical housing, the sleeve exterior surface including at least one projection extending radially outwardly with respect to the longitudinal axis. A transmission mechanism may be coupled to and adapted to rotate the sleeve, and a motor may be coupled to the transmission mechanism.

According to further aspects of this disclosure, a method of disengaging a tool housing from a wellbore wall is provided. The method may include providing a rotatable sleeve that is coupled to the tool housing, the sleeve including a projection extending radially outwardly from the sleeve. Relative rotation of the tool housing and the sleeve may be generated so that the projection engages the wellbore wall. The sleeve may be further rotated so that the projection pushes against the wellbore wall to generate a release force directed radially inwardly and away from the wellbore wall, thereby to roll the tool out of contact with the wellbore wall.

In a refinement, the method may further include extending the projection from a retracted position to an extended position prior to further rotating the sleeve.

In another refinement, the method may further include measuring a sticking force applied to the tool and adjusting a rotational speed of the sleeve according to the measured sticking force.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

This disclosure relates to apparatus and methods for disengaging downhole tools that are stuck to the wall of a wellbore, either in a drilling environment or in a wireline environment. The apparatus and methods disclosed herein effect a rolling motion of the tool, thereby reducing the effective holding force of the pressure differential that exists between the wellbore and the formation. As a result, the downhole tool is more reliably disengaged from the wellbore wall. In some refinements, the apparatus includes a sleeve with radially outwardly extending projections that may be rotated into contact with the wall thereby prying the the tool away from the wall. In another refinement, the apparatus is provided as a self-contained module incorporated into a modular tool. According to further refinements, the projections may be fixed or radially expandable/retractable.

Figure 1:
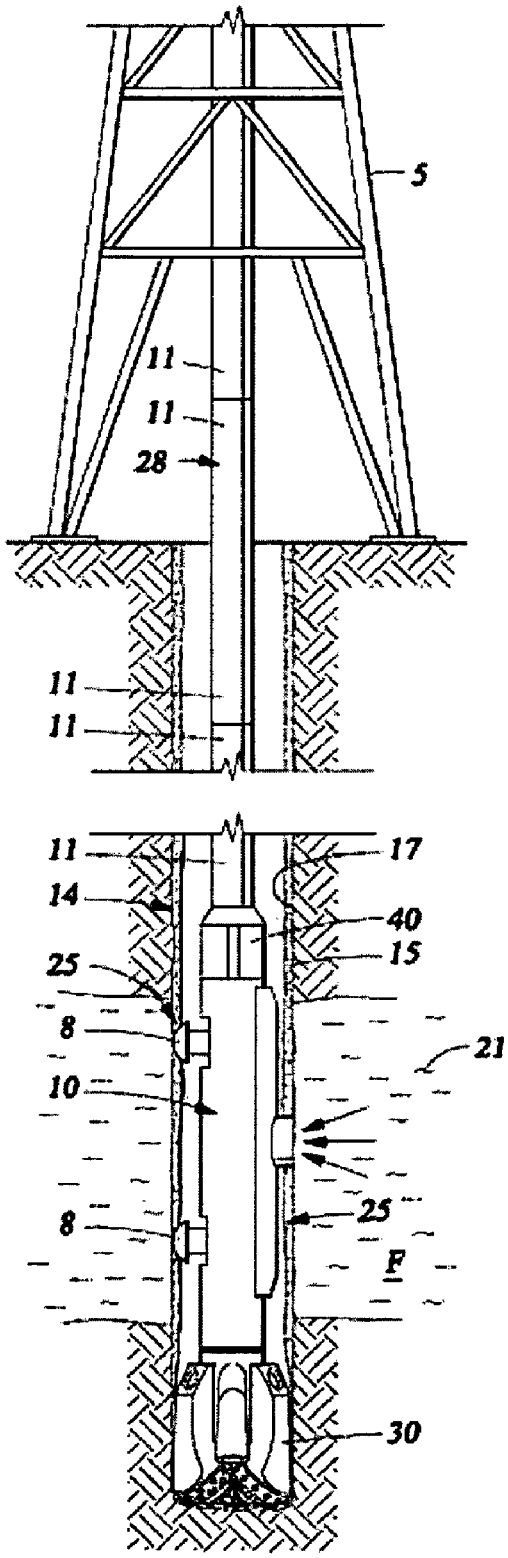
FIG. 1 is a schematic view, partially in cross-section, of a downhole tool with unsticking apparatus according to the present disclosure, in which the downhole tool is a downhole drilling tool.
Figure 2:
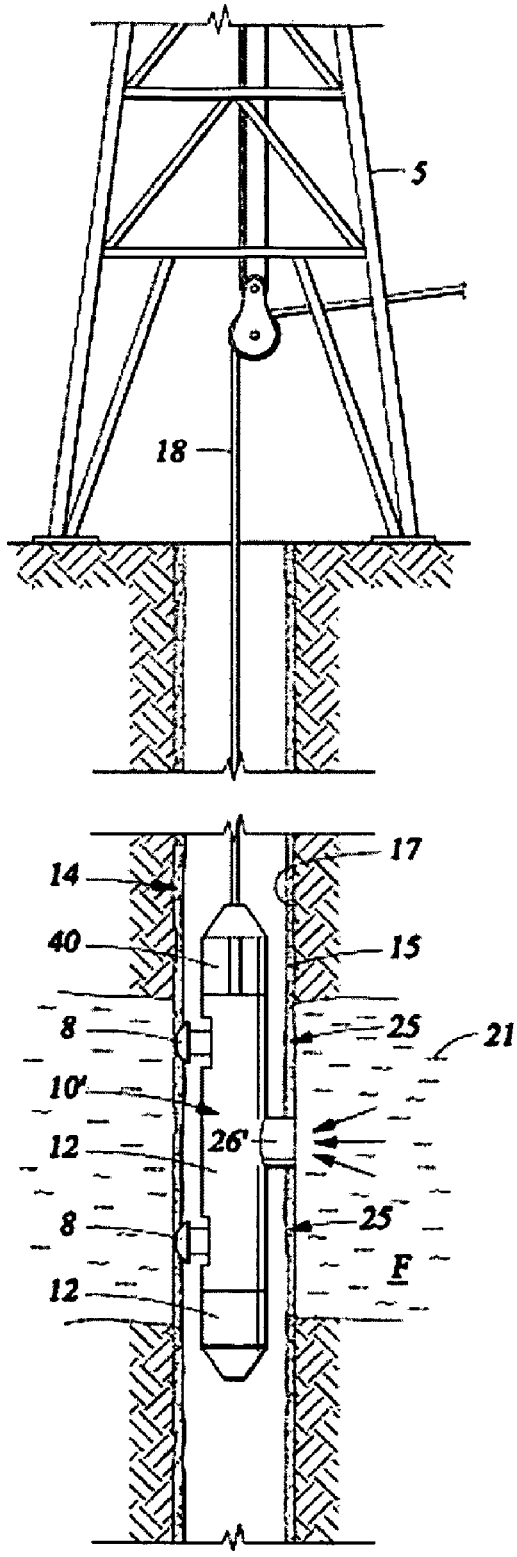
FIG. 2 is a schematic view, partially in cross-section, of a downhole tool with unsticking apparatus according to the present disclosure, in which the downhole tool is a wireline tool.

In the exemplary embodiments, a wall-disengaging assembly according to the present disclosure is carried by a downhole tool, such as the drilling tool 10 of FIG. 1 or the wireline tool 10' of FIG. 2. The wall-disengaging assembly may also be used in any other type of tool that is inserted into or forms a wellbore.

FIG. 1 depicts a downhole drilling tool 10 deployed from a rig 5 and advanced into the earth to form a wellbore 14. The wellbore penetrates a subterranean formation F containing a formation fluid 21. The downhole drilling tool is suspended from the drilling rig by one or more drill collars 11 that form a drill string 28. "Mud" is pumped through the drill string 28 and out bit 30 of the drilling tool 10. The mud is pumped back up through the wellbore and to the surface for filtering and recirculation. As the mud passes through the wellbore, it forms a mud layer or mudcake 15 along the wellbore wall 17. A portion of the mud may infiltrate the formation to form an invaded zone 25 of the formation F.

The downhole drilling tool 10 may be removed from the wellbore and a wireline tool 10' (FIG. 2) may be lowered into the wellbore via a wireline cable 18. An example of a wireline tool capable of sampling and/or testing is depicted in U.S. Pat. Nos. 4,936,139 and 4,860,581, the entire contents of which are hereby incorporated by reference. The downhole tool 10' is deployable into wellbore 14 and suspended therein with a conventional wireline 18, or conductor or conventional tubing or coiled tubing, below the rig 5. The illustrated tool 10' is provided with various modules and/or components 12 including, but not limited to, a probe 26' for establishing fluid communication with the formation F and drawing the fluid 21 into the downhole tool as shown by the arrows. Backup pistons 8 may be provided to further thrust the downhole tool 10' against the wellbore wall 17 and assist the probe in engaging the wellbore wall 17. The tools of FIGS. 1 and 2 may be modular as shown in FIG. 2 or unitary as shown in FIG. 1, or combinations thereof.

Figure 4:
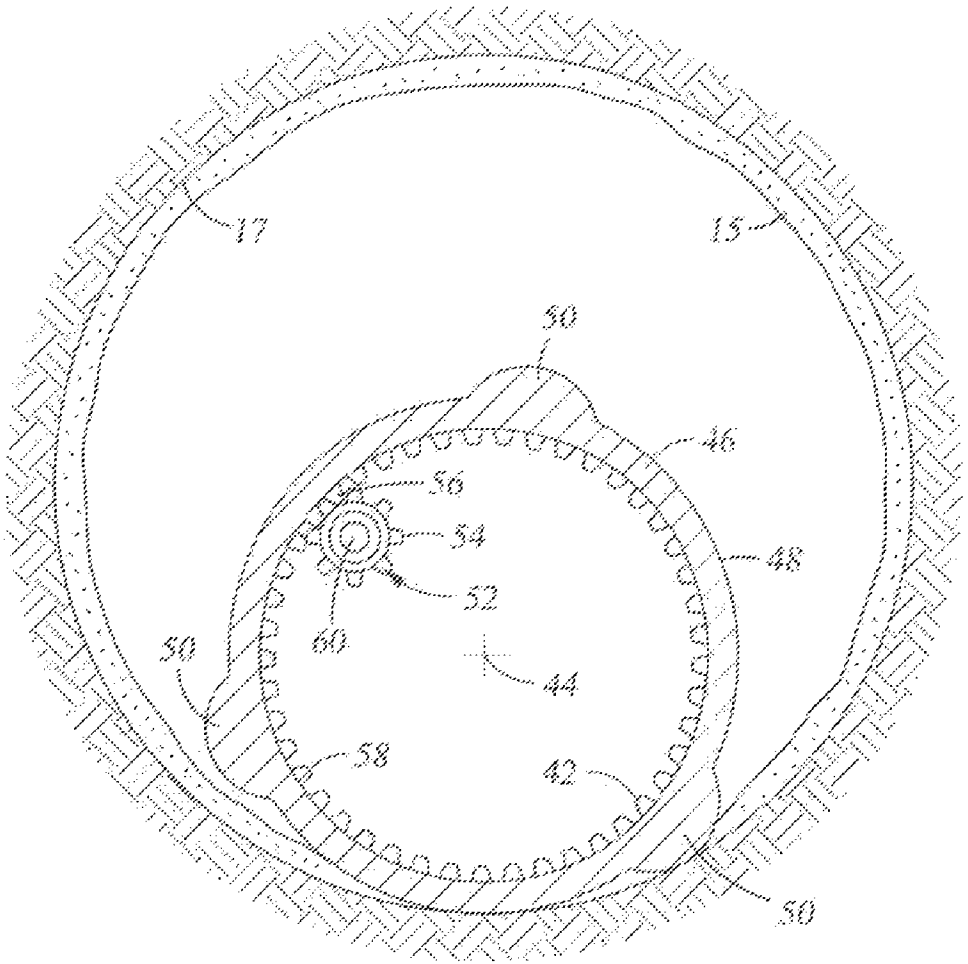
FIG. 4 is a schematic cross-sectional view of the downhole tool taken along line 4-4 of FIG. 1.
Figure 3:
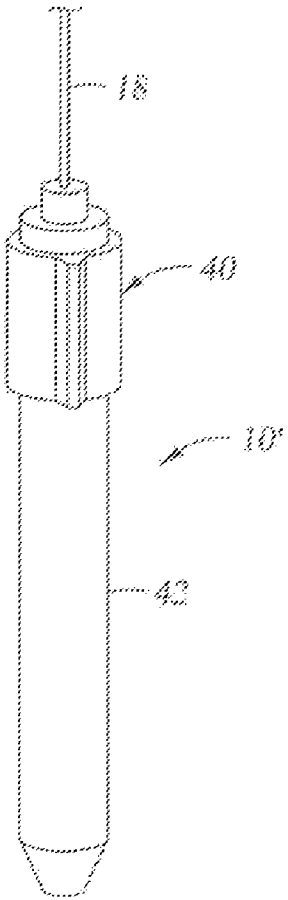
FIG. 3 is a schematic perspective view of a downhole tool including wall disengaging apparatus according to the present disclosure.

A wall disengaging assembly 40 may be provided on either the drilling tool 10 or the wireline tool 10'. The wireline tool 10' is shown in greater detail in FIG. 3, and includes a housing 42 with a top end coupled to the wireline cable 18. While the tool disengaging assembly 40 is illustrated as being positioned near the top end of the housing 42, the particular location of assembly 40 along the tool housing 42 is not critical. As best shown in FIG. 4, the housing 42 has a circular cross-section and defines a longitudinal axis 44.

The tool disengaging assembly 40 includes a rotatable sleeve 46 that rolls, rather than pulls, the tool 10' out of engagement with the wellbore wall 17. As best shown in FIG. 4, the sleeve 46 may be rotatably mounted in coaxial relation to the housing 42. The sleeve 46 has an exterior surface 48 which may define a cross-sectional profile that is larger than the cross-sectional profile of the housing 42. One or more radially outwardly extending projections 50 are provided circumferentially about the sleeve exterior surface 48 to help pry the tool away from the wellbore wall 17 as the sleeve 46 rotates.

Figure 7:
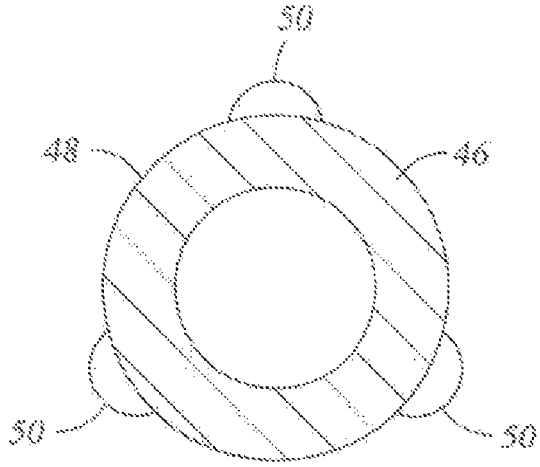
FIG. 7 is a schematic cross-sectional view of wall disengaging apparatus having fixed projections.

The shape or profile of each projection 50 may be adapted to suit a particular purpose or to fit a particular application. As illustrated in FIGS. 4 and 7, the projections 50 may have arcuate or semi-circular profiles that provide a smooth transition from the housing exterior surface 48 to each projection 50. Smooth, gradual transitions between the housing exterior surface 48 and the projections 50 may minimize the amount of damage to mudcake layer 15 during tool deployment and operation. The projections illustrated in FIGS. 4 and 7 are fixed in the sense that they maintain the same dimension in the radial direction.

Figure 8A:
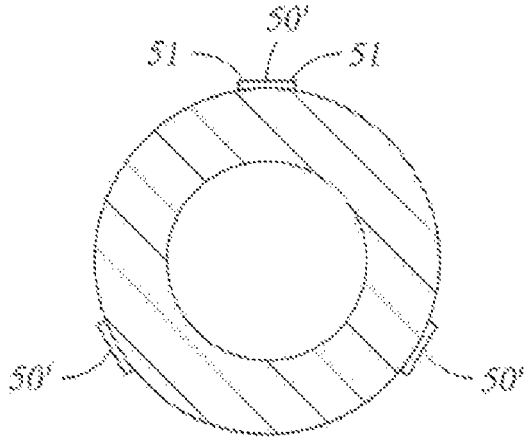
FIGS. 8A and 8B are schematic cross-sectional views of a wall disengaging apparatus having moveable projections in the retracted and extended positions, respectively.
Figure 8B:
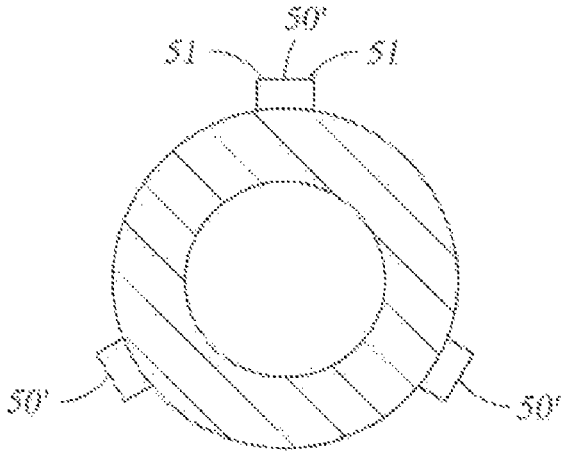

Alternatively, projections 50' may be provided that are movable between retracted and extended positions, as illustrated in FIGS. 8A and 8B, respectively. The projections 50' may be retracted as shown in FIG. 8A during transport and positioning of the tool, thereby to reduce the cross-sectional profile. When the tool is determined to be stuck, the projections 50' may be moved to the extended position shown in FIG. 8B. Extension of the projections 50' provides an initial, piston-like force that promotes separation of the tool 10' from the wellbore wall 17. With the projections 50' extended, the sleeve 46 may then be rotated to completely disengage the tool 10' from the wall 17. As shown in FIGS. 8A and 8B, the projections 50' may have a rectangular or square cross-sectional profile with sharp corners 51 rather than smooth transitions. Projections having sharp corners will increase the friction with the wellbore wall 17 and enhance the ability to roll the tool out of engagement by rotating the sleeve 46.

As used herein, a projection is a localized portion of the sleeve exterior surface 48 that is disposed at a greater radial distance from a center of rotation of the sleeve 46 than the surrounding area of the surface 48. While the projections 50, 50' are illustrated herein as discrete elements, it will be appreciated that a projection may be formed by a portion of the exterior surface 48 that is more closely integrated into the overall cross-sectional profile of the sleeve 46. For example, the sleeve exterior surface may have a triangular shape, with the corners of the triangle forming projections.

While the sleeve 46 is illustrated as having three projections, it will be appreciated that more or less than three projections may be provided without departing from the scope of the present disclosure. At a minimum, the sleeve 46 should include a least one projection 50.

Figure 5:
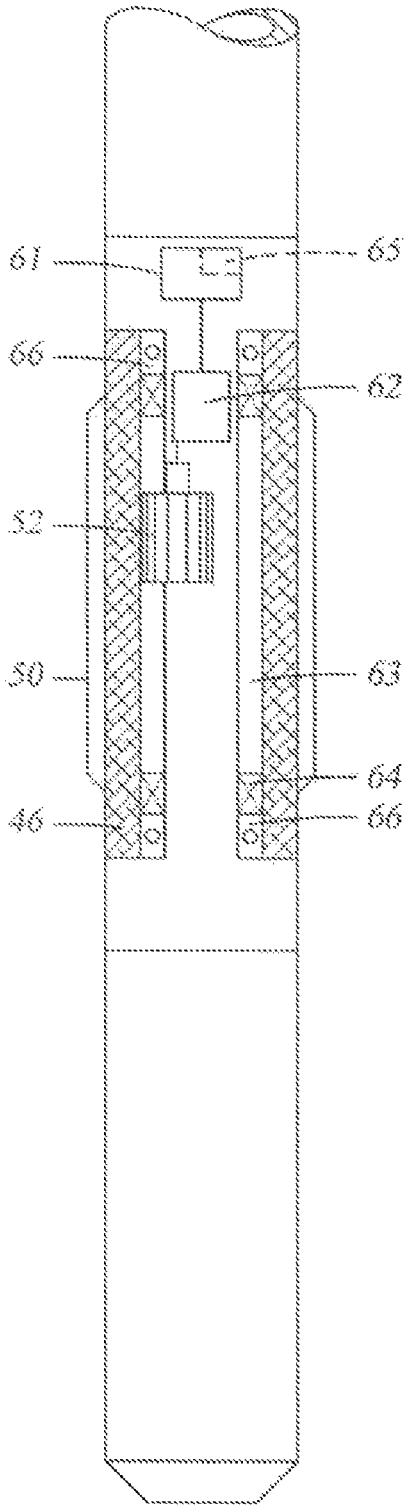
FIG. 5 is a schematic side elevation view, partially in cross-section, of an alternative embodiment of a downhole tool including wall disengagement apparatus according to the present disclosure.

A drive is provided for inducing rotational movement of the sleeve 46. In the illustrated embodiment, the drive is provided as a rotating gear 52 having teeth 54 for engaging splines 56 formed on an interior surface 58 of the sleeve 46. The gear 52 is mounted for rotation about an axle 60 disposed inside the sleeve 46. As schematically illustrated in FIG. 5, a motor 62 may be operatively coupled to the gear 52. While the illustrated embodiment includes a rotating gear 52, nay other known type of drive structure may be used that is capable of receiving an input force and transmitting it into a rotational output force that is applied to the sleeve 46.

The sleeve 46 may be supported on a mandrel 63 that is mounted on bearings 64 to facilitate rotation. A range of rotation of the sleeve 46 may be limited if desired. Seals 66 may be provided at opposite ends of the sleeve 46 to prevent infiltration by fluids or other debris. In this regard, the tool disengaging assembly 40 may be provided as a self-contained module that is coupled to other components to form a modular tool.

In operation, the assembly 40 may be used to unstick or disengage a downhole tool from a wellbore wall. For example, as the tool 10' is conveyed through the wellbore 14, it may intentionally or inadvertently come into contact with the mudcake layer 15. During formation sampling procedures, for example, backup pistons and a probe may be extended into contact with the wellbore wall 17. The tool 10' may scrape or otherwise breach the integrity of the mudcake layer 15, thereby exposing the tool 10' to the pressure differential between the wellbore 14 and the formation F. The force created by the pressure differential is exerted across a contact area between the tool 10' and the wellbore 14 (i.e. across that portion of the tool housing that is in contact with the mudcake layer). Rather than attempting to directly counteract that force with a piston, the tool disengaging assembly 40 of the present disclosure rolls the tool 10' to pry it out of contact with the wellbore wall 17, thereby reducing the releasing force needed to move the tool 10'. More specifically, the gear 52 rotates the sleeve 46 until a projection 50 engages the wellbore wall 17.

Continued rotation of the sleeve 46 causes a rolling motion of the tool 10' that pries it out of out of contact with the wellbore wall 17, thereby unsticking the tool 10'.

A controller 61 may be operatively coupled to the motor 62 for controlling rotational speed of the gear 52. If the motor 62 has a constant power output, reducing the rotational speed will increase the torque applied by the gear 52. Consequently, the rotational speed of the motor 62 may be adjusted according to the sticking load applied to the tool 10'. A sensor 65 may provide feedback to the controller 61 regarding the force resisting sleeve rotation, and the controller 61 may adjust rotational speed as needed. For example, if the sticking force is increasing, the controller 61 may slow down the rotational speed of the motor 62 to increase torque. Conversely, if the sticking force decreases, the controller 61 may increase rotational speed, with a resulting decrease in torque. The variable speed drive provided by the controller 61 adjusts operation of the tool 10' to better suit the sticking conditions.

Figure 6:
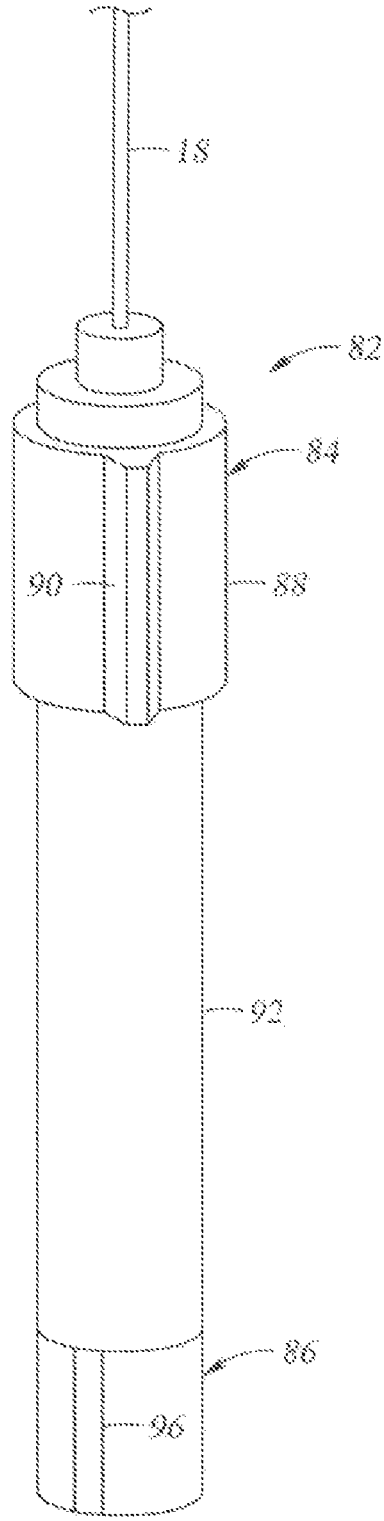
FIG. 6 is a schematic perspective view of yet another embodiment of a downhole tool including wall disengagement apparatus according to the present disclosure.

An alternative wireline tool, which includes a tool disengaging assembly 82 having upper and lower sub-assemblies 84, 86, is illustrated in FIG. 6. The upper sub-assembly 84 is similar to the tool disengaging assembly 40 disclosed above, and includes a rotatable sleeve 88 having at least one radially outwardly extending projection 90. A tool housing 92 includes an upper end coupled to the wireline cable 18 and a lower end. The lower sub-assembly 86 includes an additional, outwardly extending projection 96 that may be coupled to or integrally provided with the exterior surface of the tool housing 92. In the illustrated embodiment, the additional projection 96 is formed at the housing lower end, however the additional projection may be provided at any point along the tool housing 92. The additional projection 96 is useful in situations where the rotating sleeve 88 is stuck against the wellbore wall 17. In this situation, attempted rotation of the sleeve 88 will instead rotate the tool housing 92, so that the additional projection 96 will ultimately engage the wellbore 17 wall and pry the tool out of sticking engagement with the wall.

While the apparatus disclosed herein is clearly useful for wireline applications, it is also applicable to while drilling tools. Conventional wireline tools are inserted into the well after the wellbore wall has been formed and therefore do not typically include components for rotating the housing. As such, the tool disengaging apparatus disclosed herein adds this capability to a wireline tool. Drill strings, on the other hand, typically already include components for rotating the tool. Drilling tools, however, are still prone to sticking particularly in certain applications such as inclined or deviated wells, and therefore the tool disengaging apparatus disclosed herein is useful for drilling tools as well.

While only certain embodiments have been set forth, alternatives and modifications will be apparent from the above description to those skilled in the art. These and other alternatives are considered equivalents and within the spirit and scope of this disclosure and the appended claims.

What is claimed:

1. A downhole tool for use within a wellbore extending into an underground formation, comprising:

a wellbore wall disengaging assembly, comprising:

a housing defining a longitudinal axis;

a sleeve having a substantially contiguous outer profile, wherein the outer profile of the sleeve comprises at least one projection extending radially outward and configured to translate the longitudinal axis of the housing away from the wellbore wall in response to rotation of the sleeve relative to the housing; and a drive configured to induce the rotation of the sleeve relative to the housing, wherein the drive comprises a rotating gear having teeth configured to engage corresponding splines formed on an interior surface of the sleeve.

2. The downhole tool of claim 1 wherein the sleeve is rotatably mounted in coaxial relation to the housing.

3. The downhole tool of claim 1 wherein the at least one projection comprises a localized portion of the sleeve that extends a greater radial distance from a center of rotation of the sleeve than the surrounding area of the sleeve.

4. The downhole tool of claim 1 wherein the wellbore wall disengaging assembly further comprises a motor operatively coupled to the gear.

5. The downhole tool of claim 1 wherein the wellbore wall disengaging assembly further comprises a mandrel on which the sleeve is supported via bearings configured to allow rotation of the sleeve relative to the mandrel.

6. The downhole tool of claim 5 wherein the wellbore wall disengaging assembly further comprises seals provided at opposite ends of the sleeve and configured to prevent infiltration of fluids.

7. The downhole tool of claim 1 wherein the at least one projection comprises at least three projections.

8. The downhole tool of claim 1 wherein the housing comprises a substantially contiguous outer profile, wherein the outer profile of the housing comprises at least one projection extending radially outward and configured to translate the longitudinal axis of the housing away from the wellbore wall in response to rotation of the sleeve relative to the housing.

9. A method of disengaging a downhole tool from a wall of a wellbore extending into an underground formation, comprising:

generating relative rotation between a housing and a sleeve, wherein:

the housing defines a longitudinal axis;

the sleeve has a substantially contiguous outer profile; and the outer profile of the sleeve comprises at least one projection extending radially outward and configured to translate the longitudinal axis of the housing away from the wellbore wall in response to the relative rotation between the sleeve and the housing; and translating the downhole tool axially within the wellbore after the relative rotation between the housing and the sleeve causes sufficient translation of the longitudinal axis of the housing away from the wellbore wall to disengage the downhole tool from the wellbore wall;

wherein generating the relative rotation between the housing and the sleeve comprises actuating a drive configured to induce the relative rotation; and wherein the drive comprises a rotating gear having teeth configured to engage corresponding splines formed on an interior surface of the sleeve.

10. The method of claim 9 wherein the at least one projection comprises at least three projections.

11. The method of claim 9 further comprising measuring a sticking force applied to the tool and adjusting a rotational speed of the sleeve based on the measured sticking force.

12. The method of claim 9 wherein the sleeve is rotatably mounted in coaxial relation to the housing.

13. The method of claim 9 wherein the at least one projection comprises a localized portion of the sleeve that extends a greater radial distance from a center of rotation of the sleeve than the surrounding area of the sleeve.

14. The method of claim 9 wherein actuating the drive comprises actuating a motor operatively coupled to the gear.

15. A downhole tool for use within a wellbore extending into an underground formation, comprising:

a wellbore wall disengaging assembly, comprising:

a housing defining a longitudinal axis; and a sleeve having a substantially contiguous outer profile, wherein the outer profile of the sleeve comprises at least one projection extending radially outward and configured to translate the longitudinal axis of the housing away from the wellbore wall in response to rotation of the sleeve relative to the housing;

wherein the housing comprises a substantially contiguous outer profile, wherein the outer profile of the housing comprises at least one projection extending radially outward and configured to translate the longitudinal axis of the housing away from the wellbore wall in response to rotation of the sleeve relative to the housing; and a drive configured to induce the rotation of the sleeve relative to the housing, wherein the drive comprises a rotating gear having teeth configured to engage corresponding splines formed on an interior surface of the sleeve.

* * * * *